US008911065B2

(12) United States Patent
Miyazaki et al.

(10) Patent No.: US 8,911,065 B2
(45) Date of Patent: Dec. 16, 2014

(54) LIQUID EJECTING APPARATUS

(71) Applicant: Seiko Epson Corporation, Tokyo (JP)

(72) Inventors: Kenichi Miyazaki, Shiojiri (JP); Akira Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/013,761

(22) Filed: Aug. 29, 2013

(65) Prior Publication Data

US 2014/0063142 A1 Mar. 6, 2014

(30) Foreign Application Priority Data

Aug. 31, 2012 (JP) ..... 2012-191472

(51) Int. Cl.
*B41J 2/175* (2006.01)
*B41J 2/165* (2006.01)

(52) U.S. Cl.
CPC ..... *B41J 2/175* (2013.01)
USPC ..... 347/85; 347/29; 347/86

(58) Field of Classification Search
CPC ..... B41J 2/16508; B41J 2/17513; B41J 2/175
USPC ..... 347/29.85, 86, 29, 85
See application file for complete search history.

(56) References Cited

U.S. PATENT DOCUMENTS

2010/0079537 A1* 4/2010 Watanabe ..... 347/29

FOREIGN PATENT DOCUMENTS

JP 2009-202346 9/2009

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting portion capable of ejecting ink, a liquid container provided with an injection port for ink, and a liquid reception portion disposed on a lower side of the injection port.

6 Claims, 11 Drawing Sheets

LIQUID EJECTING APPARATUS

BACKGROUND

1. Technical Field

The present invention relates to a liquid ejecting apparatus capable of ejecting liquid supplied from a liquid container.

2. Related Art

In recent years, an ink-jet type printer (hereinafter, simply referred to as a printer) which performs printing by ejecting ink accommodated in an ink cartridge onto a medium, such as a paper sheet, has been known as a liquid ejecting apparatus capable of ejecting liquid.

In such a printer, the ink cartridge is detachably mounted in a casing body. Therefore, replenishment of ink is generally carried out by replacing the ink cartridge with new one.

However, it is necessary for the ink cartridge to have a size enabling it to be accommodated in the casing body, and therefore it is difficult to increase the size of the ink cartridge. Thus, when a large quantity of printing is conducted, it is necessary to interrupt the printing and perform a replacement each time the ink in the ink cartridge runs out.

In order to reduce the frequency of the replacement of an ink cartridge, a printer has been disclosed in which the replenishment of ink is conducted by injecting ink from an ink pack provided outside a casing body into an ink cartridge mounted to the casing body, via an ink tube (see JP-A-2009-202346, for example).

Incidentally, when an injection port for ink is provided on the ink cartridge, there is a possibility that ink may evaporate through the injection port or dust may enter through the injection port. Therefore, it is preferable that the opening size thereof be set as small as possible. However, if the opening size of the injection port is small, it is difficult to inject ink therethrough. Thus, there is a problem in that a leakage of ink may be caused at the time of injection. In addition, when ink leaks out with the injection of ink, for example at the time of attaching/detaching an ink tube, there is a possibility that the leaked ink may scatter around and contaminate the surrounding area.

Such a problem is not limited to a printer in which ink is injected into an ink cartridge via an ink tube but is generally common to a liquid ejecting apparatus equipped with a liquid container having an injection port for liquid.

SUMMARY

An advantage of some aspects of the invention is to provide a liquid ejecting apparatus in which the scattering of liquid leaked at the time of being injected into a liquid container can be suppressed.

Hereinafter, means for solving the problem described above and operation effects thereof will be described.

According to an aspect of the invention, there is provided a liquid ejecting apparatus including: a liquid ejecting portion capable of ejecting liquid; a liquid container provided with an injection port for liquid; and a liquid reception portion disposed on a lower side of the injection port.

According to the configuration, liquid leaked at the time of injection is received by the liquid reception portion disposed on the lower side of the injection port provided on the liquid container. Therefore, it is possible to suppress the scattering of the ink leaked at the time of being injected into the liquid container.

In the liquid ejecting apparatus, it is preferable that an inclined portion inclined downward be provided on an upper surface side of the liquid reception portion.

According to the configuration, the liquid received by the liquid reception portion flows along the inclined portion and is collected in the lower side. Therefore, it is possible to easily remove the leaked liquid.

In the liquid ejecting apparatus, it is preferable that a liquid storage portion capable of storing liquid be provided on a lower end side of the inclined portion in the liquid reception portion.

According to the configuration, it is possible to store the liquid, which is received by the liquid reception portion, flows along the inclined portion and is collected, in the liquid storage portion. Thus, it is possible to reduce the frequency of removing the leaked liquid.

It is preferable that the liquid ejecting apparatus additionally include: a liquid supply mechanism for supplying liquid accommodated in the liquid container to the liquid ejecting portion; and a casing body which accommodates the liquid ejecting portion and the liquid supply mechanism. Furthermore, the liquid container may have a connecting portion connected with the liquid supply mechanism in the casing body and a protruding portion protruding outside the casing body. In addition, the injection port may be provided on the protruding portion, and the liquid reception portion is disposed on a lower side of the protruding portion.

According to the configuration, the injection port is provided on the protruding portion of the liquid container which is disposed outside the casing body. Therefore, it is easy to inject liquid therethrough. Furthermore, even when liquid leaks out at the time of injection, the contamination of the inside of the casing body by the leaked liquid is suppressed. Moreover, the liquid reception portion is disposed on the lower side of the protruding portion, and therefore it is possible to receive ink which leaks out at the time of injection and falls along the liquid container.

In the liquid ejecting apparatus, it is preferable that a container support portion for supporting the protruding portion be provided on the casing body.

According to the configuration, the protruding portion is stably supported by the container support portion. Therefore, it is possible to suppress the leakage of liquid at the time of injection.

It is preferable that the liquid ejecting apparatus include a support member which supports the liquid reception portion and has a joining portion to be joined to the liquid reception portion at a position located closer to the casing body side than the injection port in a protruding direction. Further, the protruding portion of the liquid container may protrude from the casing body in the protruding direction intersecting an up-down direction. In addition, the liquid reception portion may have a plate shape inclined so as to be gradually lowered from the casing body side in the protruding direction.

According to the configuration, the joining portion of the support member is joined to the liquid reception portion at the position located closer to the casing body side than the injection port in the protruding direction. Thus, even when a screw hole or the like used for joining is provided on the liquid reception portion, the leakage of the ink received by the liquid reception portion is suppressed.

In the liquid ejecting apparatus, it is preferable that a space be provided between the liquid container and the liquid reception portion.

According to the configuration, a space is provided between the liquid container and the liquid reception portion. Therefore, it is possible to suppress the adhesion of the liquid, which is received by the liquid reception portion, to the liquid container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to drawings.

First Embodiment

Figure 1:
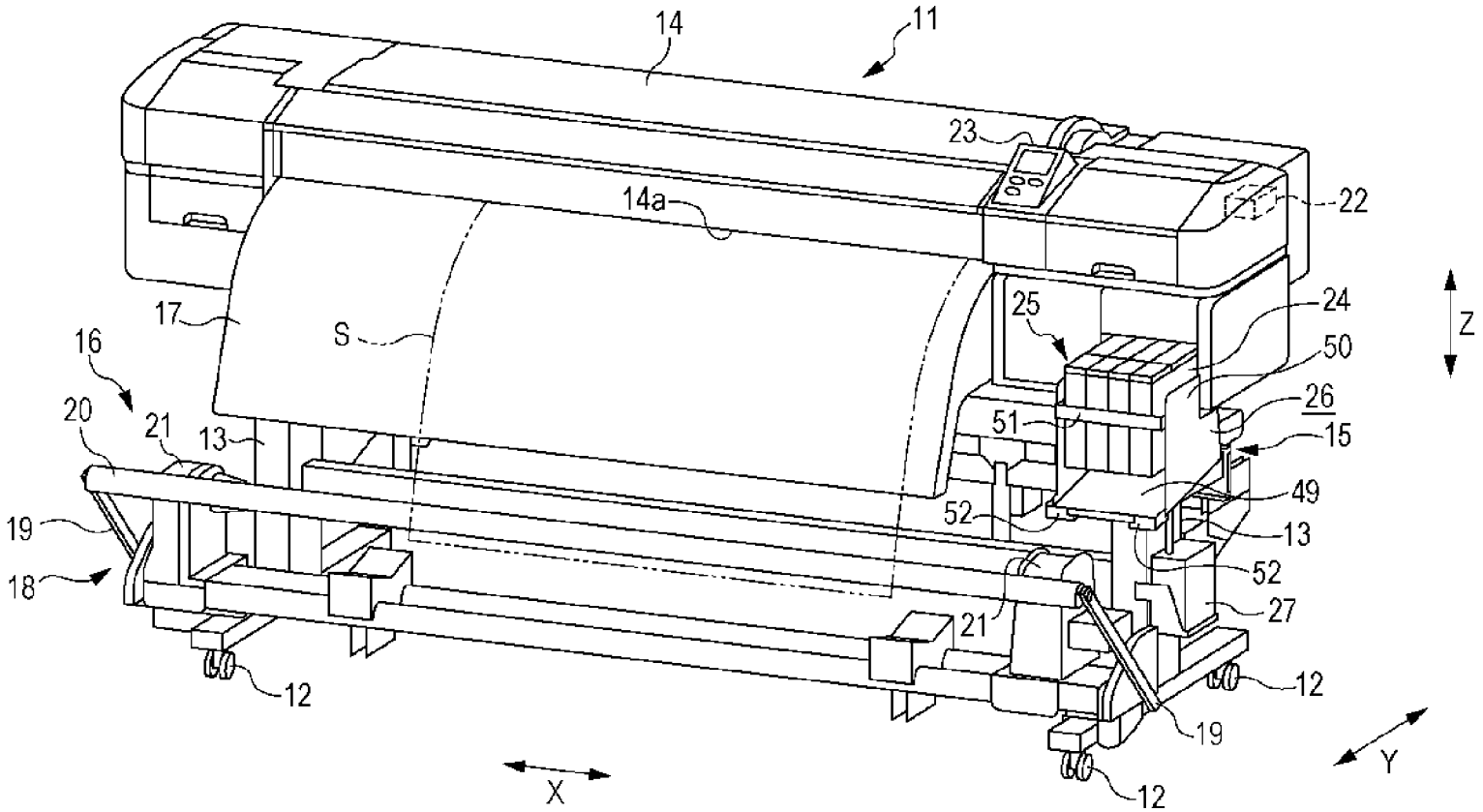
FIG. 1 is a perspective view of a liquid ejecting apparatus according to a first embodiment.

As shown in FIG. 1, a liquid ejecting apparatus 11 of a first embodiment is a large format printer (LFP) handling a lengthy paper sheet S as an example of a medium. The liquid ejecting apparatus 11 includes a pair of leg portions 13 which is provided with wheels 12 on lower ends thereof, and a casing body 14 assembled on the leg portions 13. Furthermore, in the embodiment, a longitudinal direction of the casing body 14 which intersects (perpendicularly, in the embodiment) an up-down direction Z parallel to a gravity direction is designated as a width direction X. In addition, a direction intersecting (perpendicularly, in the embodiment) both the up-down direction Z and the width direction X is designated as a front-rear direction Y.

A feeding portion 15 for feeding the paper sheet S to the casing body 14 is disposed on a lower portion of a rear side of the casing body 14. In addition, a winding portion 16 supported by the leg portions 13 is disposed on a lower portion of a front side of the casing body 14. Furthermore, a support member 17 is disposed between the feeding portion 15 and the winding portion 16 so as to be placed along a transporting path of a paper sheet S.

A rear end side of the support member 17 is accommodated in the casing body 14, and a front end side thereof protrudes from the casing body 14 downwardly to the front side. Furthermore, a discharging port 14*a* for discharging the paper sheet S from the inside of the casing body 14 is formed on a front surface side of the casing body 14. The discharging port 14*a* is positioned at the upper side of the support member 17.

A tension applying mechanism 18 which applies tension to the paper sheet S positioned between the support member 17 and the winding portion 16 is provided in the vicinity of the winding portion 16. The tension applying mechanism 18 includes a pair of arm members 19 which is rotatably supported by the lower portion of the leg portion 13, and a tension roller 20 which is rotatably supported by tip portions of the pair of arm members 19.

The winding portion 16 includes a pair of holders 21 which interposes a core material (not shown) therebetween from both axial sides. The printed paper sheet S is wound on the core material (a paper tube, for example), and therefore has a cylindrical shape. The paper sheet S is wound on the core material mounted between the pair of holders 21 by rotating one (a right-side holder in FIG. 1) of the holders 21. In other words, the winding portion 16 constitutes a transporting mechanism, and the holders 21 are positioned at a downstream end of the transporting path of a paper sheet S. Furthermore, a spindleless type device which is not provided with a spindle is adopted as the winding portion 16 of the embodiment. However, it is possible to adopt a spindle type device.

A control portion 22 for controlling an operation of the liquid ejecting apparatus 11 is provided in the casing body 14. Furthermore, an operation panel 23 for conducting a setting operation or an input operation is provided on an upper portion of the casing body 14. Specifically, the operation panel 23 is positioned on one end side (a right end side in FIG. 1) of the upper portion in the width direction X, which is outside the transporting path of a paper sheet S. In addition, the operation panel 23 is electrically connected with the control portion 22.

A liquid container 24 capable of accommodating ink as an example of the liquid is provided on the lower portion of the casing body 14. Specifically, the liquid container 24 is positioned on one end side (the right end side in FIG. 1) of the lower portion in the width direction X, which is outside the transporting path of a paper sheet S. A plurality (four in the embodiment) of liquid containers 24 are provided corresponding to types or colors of ink. Further, the plurality of liquid containers 24 are mounted to the casing body 14 in a state of being aligned in the width direction X. The mounted liquid containers 24 constitute a liquid accommodating unit 25.

The liquid ejecting apparatus 11 includes a protecting portion 26 which surrounds the liquid accommodating unit 25 for protecting the liquid container 24. Furthermore, the protecting portion 26 is disposed so as to provide a space between the protecting portion 26 and the liquid container 24. In addition, a waste liquid tank 27 is fixed to one (a right side one in FIG. 1) of the leg portions 13.

Figure 2:
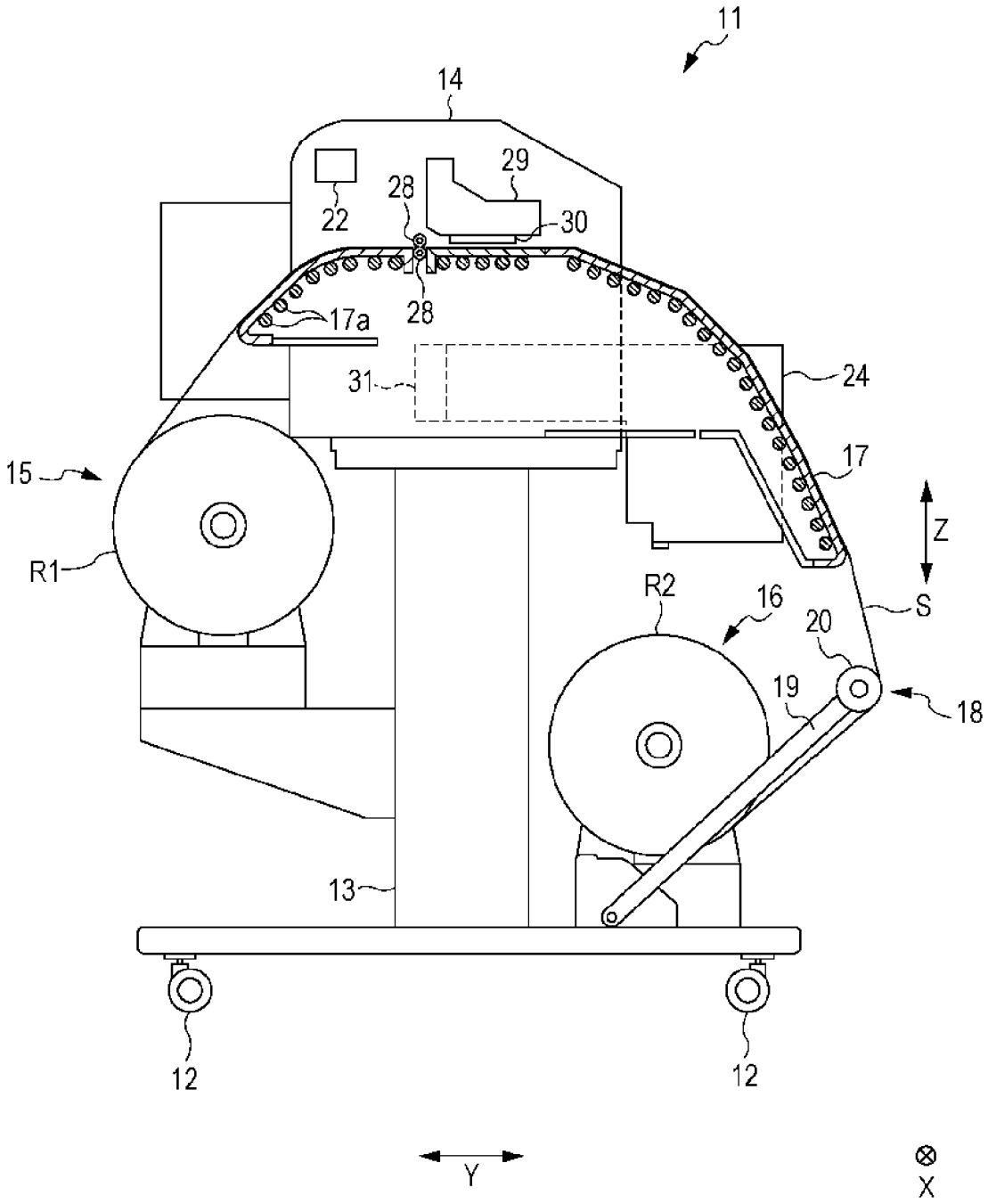
FIG. 2 is a cross-sectional view showing a schematic configuration of the liquid ejecting apparatus according to the first embodiment.

A roll body R1 which is an unused paper sheet S wound in a cylindrical shape is held in the feeding portion 15, as shown in FIG. 2. In addition, a pair of transporting rollers 28, which transports the paper sheet S sent from the feeding portion 15, and a carriage 29, which reciprocates in a main scanning direction (the width direction X in the embodiment) perpendicular to the transporting direction of the paper sheet S is accommodated in the casing body 14. Furthermore, a liquid ejecting portion 30 capable of ejecting ink is held on the lower portion of the carriage 29.

In the liquid container 24, an end portion on a base end side (a rear end side in the embodiment) accommodated in the casing body 14 is connected to a liquid supply mechanism 31 for supplying ink to the liquid ejecting portion 30. Furthermore, recording (printing) is carried out by causing the liquid ejecting portion 30 to eject the ink supplied from the liquid container 24 onto the paper sheet S transported along the transporting path.

In addition, heaters 17*a* for drying the ink adhered to the paper sheet S are provided on a rear side of the support member 17. Further, the printed paper sheet S is guided obliquely downward along the support member 17. Then the printed paper sheet S is wound by the winding portion 16 and forms a roll body R2.

Figure 3:
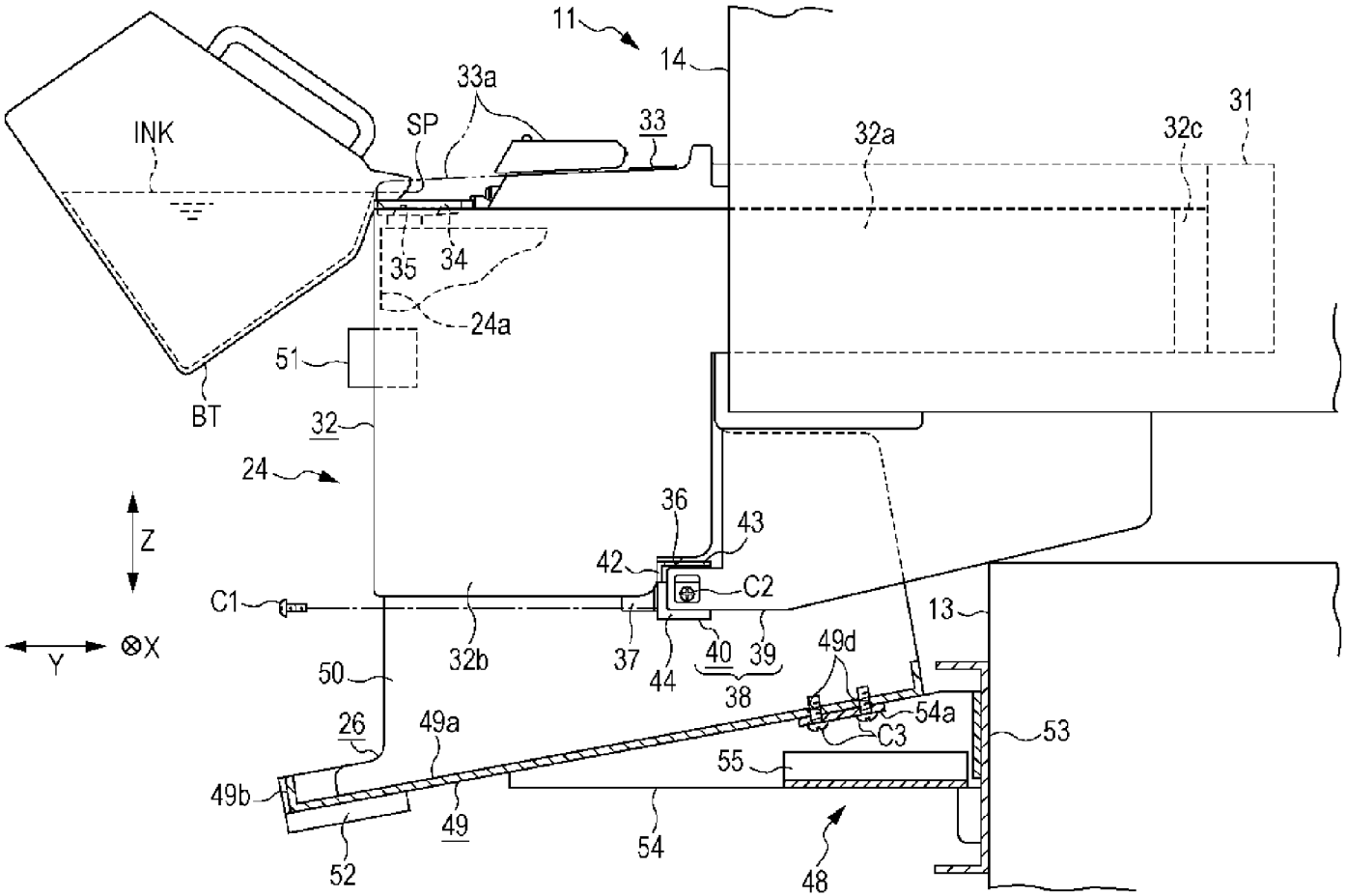
FIG. 3 is a cross-sectional view showing a periphery of a liquid container.

The liquid container 24 includes a liquid accommodating body 32 in which an accommodation chamber 24*a* for accommodating ink is formed, and a slider 33 moving slidably in the front-rear direction Y along an upper surface of the liquid accommodating body 32, as shown in FIG. 3.

In the slider 33, a part thereof on a front end side forms a pivot type lid portion 33*a*. The lid portion 33*a* of the slider 33 moves from a closed position shown by a two-dot chain line in FIG. 3 to an opened position shown by a solid line by pivoting upwardly.

When the lid portion 33*a* of the slider 33 is disposed at the closed position, an injection recess portion 34 which is formed on an upper surface side of the liquid accommodating body 32 and an injection port 35 which is formed on an inner bottom portion of the injection recess portion 34 and used to inject ink are exposed. In addition, the injection port 35 communicates with the accommodation chamber 24*a*.

When refilling the liquid container 24 with ink, ink accommodated in a refilling container BT having a pouring port SP is injected through the injection port 35. Further, an opening size of the pouring port SP of the refilling container BT is set to be 20% to 80% of an opening size of the injection port 35.

The liquid accommodating body 32 has a base end portion 32*a* accommodated in the casing body 14 and a protruding portion 32*b*. The protruding portion 32*b* protrudes from the casing body 14 in a protruding direction (a front direction in the embodiment) intersecting the up-down direction Z. Furthermore, in the liquid accommodating body 32, a connecting portion 32*c* which is connected with the liquid supply mechanism 31 in the casing body 14 so as to enable ink to be supplied is provided in the base end portion 32*a*. In addition, a bottom portion of the base end portion 32*a* of the liquid container 24 is supported inside the casing body 14.

The protruding portion 32*b* of the liquid accommodating body 32 extends downward further than the base end portion 32*a*. Further, a bottom portion of the protruding portion 32*b* in the liquid container 24 is disposed at a position located further downward than a bottom portion of the casing body 14. Additionally, in the liquid accommodating body 32, a stepped bottom portion 36 is formed on a lower portion of a rear side of the protruding portion 32*b*. Further, a screw fastening projection portion 37 projects from the lower end portion of the protruding portion 32*b* in the liquid accommodating body 32. Specifically, the screw fastening projection portion 37 is positioned on the front side of the stepped bottom portion 36 in the front-rear direction Y.

The protruding portion 32*b* of the liquid accommodating body 32 is supported by a container support portion 38 provided in the casing body 14. The container support portion 38 includes a fixing member 39 and a placing member 40 installed on a tip side of the fixing member 39. A base end side, namely a rear end side, of the fixing member 39 is fixed to a lower surface side of the casing body 14.

The placing member 40 has a screw fastening portion 42 which is positioned on the front end side and extends in the up-down direction Z and the width direction X, a placing portion 43 which intersects the upper end side of the screw fastening portion 42 and extends in the width direction X and the front-rear direction Y, and a pair of side wall portions 44 which intersects end portions of the screw fastening portion 42 in the width direction X.

The stepped bottom portion 36 of the liquid accommodating body 32 is placed on the placing portion 43 of the placing member 40. Then, the liquid accommodating body 32 is fixed to the casing body 14 by screwing the screw fastening projection portion 37 to the screw fastening portion 42 of the placing member 40 using a screw C1. Further, the protruding portion 32*b* side of the liquid container 24 is supported by the container support portion 38. In other words, a part of the liquid container 24 on the base end portion 32*a* side is supported inside the casing body 14, and a part of the liquid container 24 on the protruding portion 32*b* side is supported outside the casing body 14.

Figure 4:
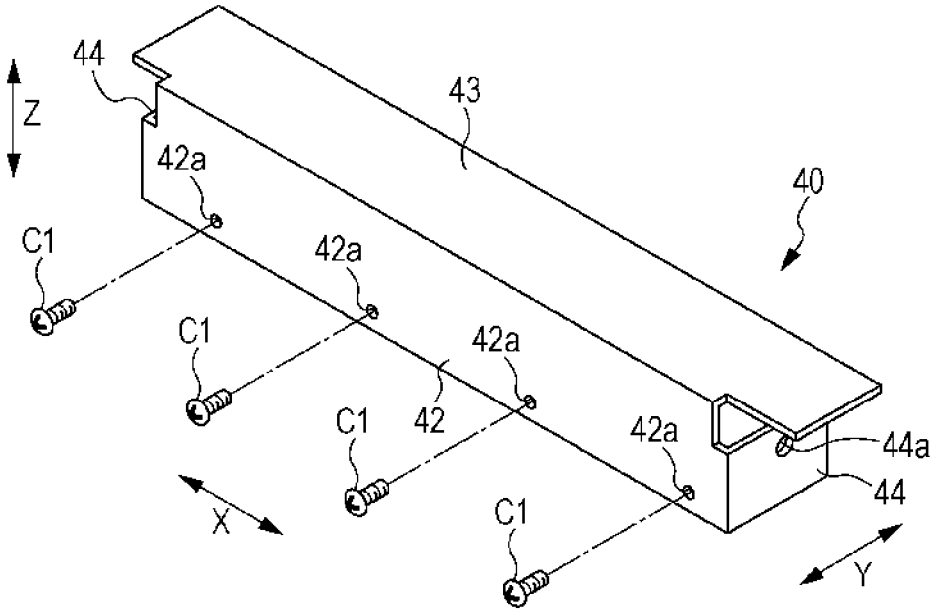
FIG. 4 is a perspective view of a placing member.

A plurality of (four in the embodiment) screw fastening holes 42*a* for fastening the screws C1 are formed on the screw fastening portion 42 of the placing member 40, as shown in FIG. 4. In addition, screw holes 44*a* are respectively formed on both side wall portions 44. Furthermore, a space is provided between the side wall portion 44 of the placing member 40 and the placing portion 43, in the up-down direction Z. Further, the placing portion 43 protrudes more than the screw fastening portion 42, in the width direction X.

Figure 5:
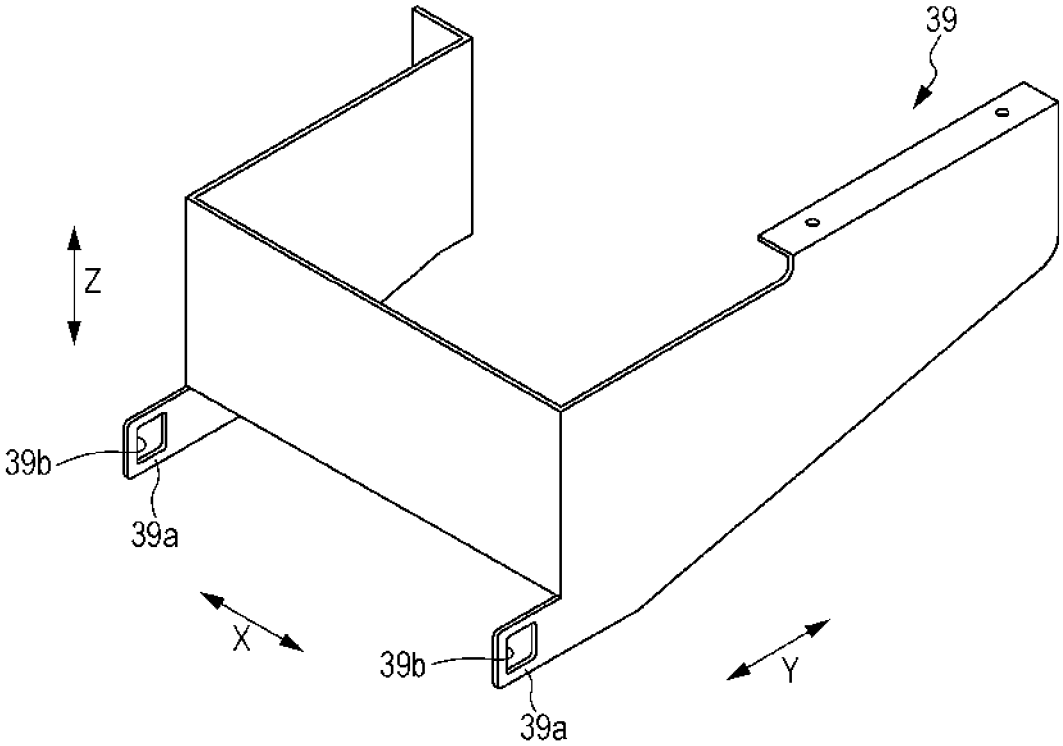
FIG. 5 is a perspective view of a fixing member.

As shown in FIG. 5, a pair of support side walls 39*a* is provided on a tip side of the fixing member 39 so as to face each other. In addition, insertion holes 39*b* are respectively formed on both support side walls 39*a*.

Figure 6:
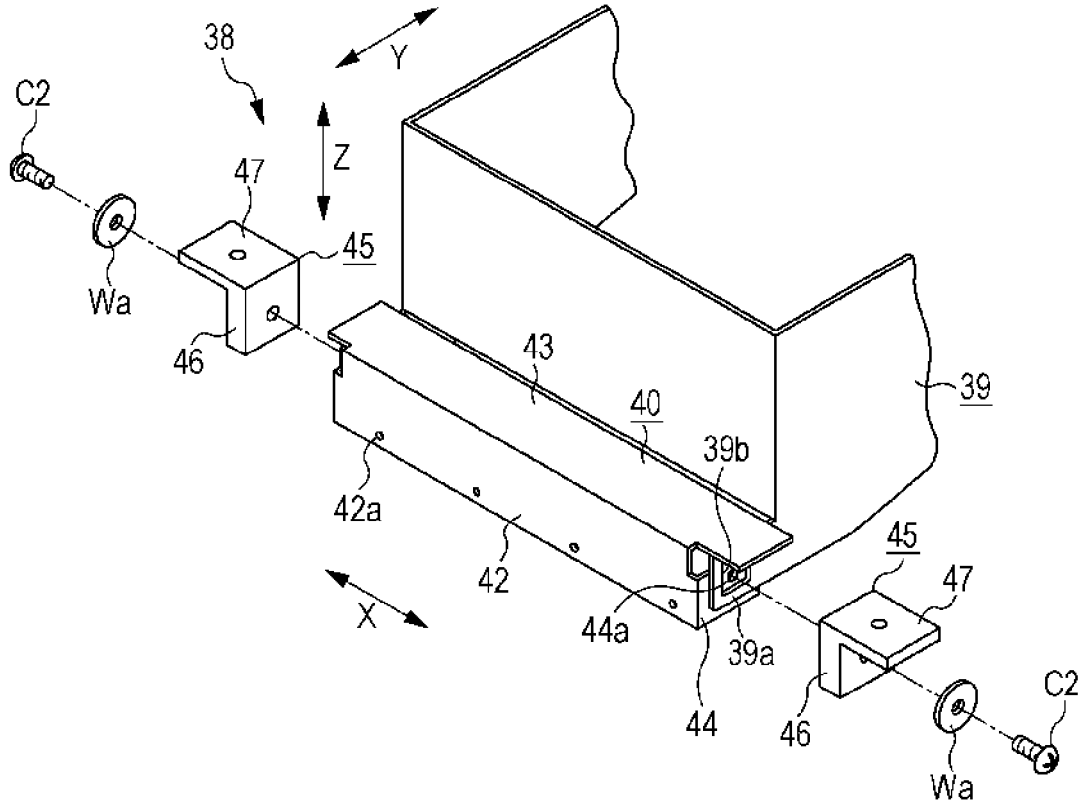
FIG. 6 is a perspective view showing a configuration of an adjustment mechanism.

As shown in FIG. 6, the placing member 40 is combined with the fixing member 39 such that the placing portion 43 is disposed above the support side walls 39*a* of the fixing member 39 and the pair of side wall portions 44 is disposed inside the pair of support side walls 39*a* of the fixing member 39. Then, the placing member 40 is screwed to the fixing member 39 by a screw C2 and a washer Wa. The screw C2 is inserted into a screw hole 44*a* of the placing member 40 and the insertion hole 39*b* of the fixing member 39.

At this time, a pair of adjusting members 45 is installed on the container support portion 38 by the screw C2. The adjusting member 45 has a first adjustment portion 46 and a second adjustment portion 47 which have a plate shape and intersect (perpendicularly, in the embodiment) each other. Subsequently, the first adjustment portion 46 or the second adjustment portion 47 of the adjusting member 45 is interposed between the support side wall 39*a* of the fixing member 39 and the placing portion 43 of the placing member 40. Thus, the position (a height) of the placing portion 43 is adjusted.

Furthermore, when the adjusting member 45 is installed as shown in FIG. 6, it is considered that the placing portion 43 is disposed at a reference position. Further, the adjusting member 45 and the washer Wa are not included in FIG. 3 to place more focus on the configuration of the fixing member 39.

Figure 7:
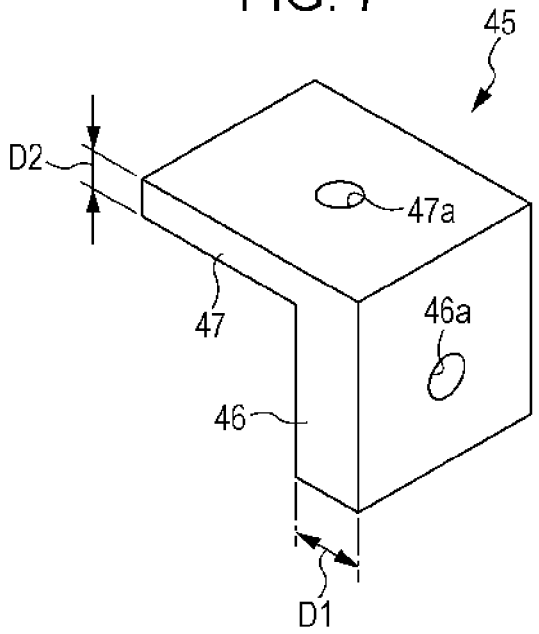
FIG. 7 is a perspective view of an adjusting member.

A first insertion hole 46*a* is formed on the first adjustment portion 46 of the adjusting member 45, as shown in FIG. 7. In addition, a second insertion hole 47*a* is formed on the second adjustment portion 47 of the adjusting member 45. Further, in the adjusting member 45, a thickness D1 of the first adjustment portion 46 is set to be greater (thicker) than a thickness D2 of the second adjustment portion 47 (D1>D2). If the thickness D1 of the first adjustment portion 46 is 8 mm, the thickness D2 of the second adjustment portion 47 can be set to 4 mm, for example.

Figure 8:
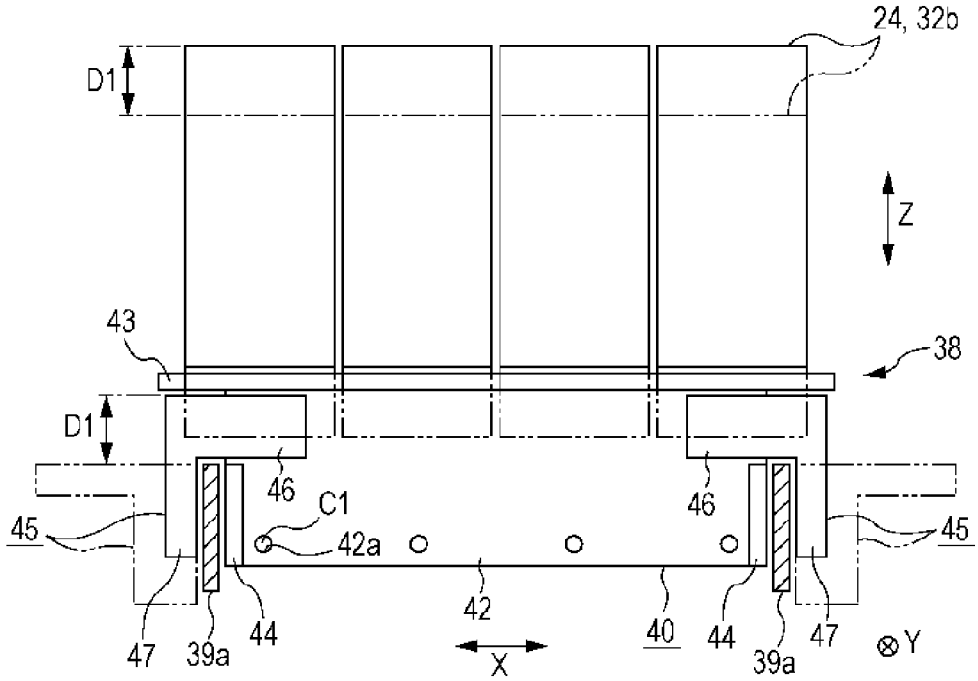
FIG. 8 is a cross-sectional view for describing an operation by a first adjustment portion of the adjusting member.

By interposing the first adjustment portion 46 of the adjusting member 45 between the support side wall 39*a* and the placing portion 43, a position of the protruding portion 32*b* side of the liquid container 24 is raised, from the reference position shown by a two-dot chain line in FIG. 8, in the up-down direction Z as much as the thickness D1, as shown in FIG. 8. In addition, a space provided between the side wall portion 44 and the placing portion 43 of the placing member 40 is greater than the thickness D1 so as to enable the first adjustment portion 46 of the adjusting member 45 to be inserted thereto.

Figure 9:
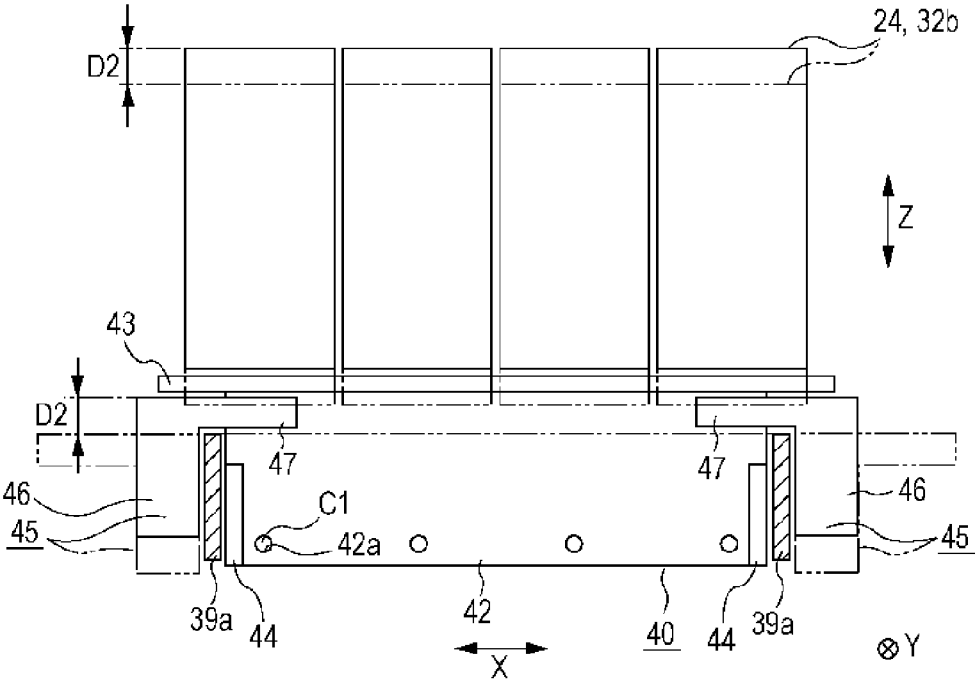
FIG. 9 is a cross-sectional view for describing an operation by a second adjustment portion of the adjusting member.

By interposing the second adjustment portion 47 of the adjusting member 45 between the support side wall 39*a* and the placing portion 43, a position of the protruding portion 32*b* side of the liquid container 24 is raised, from the reference position shown by a two-dot chain line in FIG. 9, in the up-down direction Z as much as the thickness D2, as shown in FIG. 9.

When the adjusting member 45 is placed at the reference position, the adjusting member 45 is not disposed between the support side wall 39*a* of the fixing member 39 and the placing portion 43 of the placing member 40. In this case, the adjusting member 45 is simply installed on the container support portion 38, as shown by two-dot chain lines in FIGS. 8 and 9. Therefore, by changing the position of the adjusting member 45 so as to change the height of the placing portion 43, the height of the front end side of the liquid container 24 which is placed on the placing portion 43 is adjusted in plural stages (three stages in which the distance from the reference position is 0 mm, 4 mm or 8 mm are provided in the embodiment). As described above, the fixing member 39, the placing member 40 and the adjusting member 45 constitute an adjustment mechanism for adjusting the position of the protruding portion 32*b* in the up-down direction.

Next, a configuration of the protecting portion 26 will be described in detail.

Figure 10:
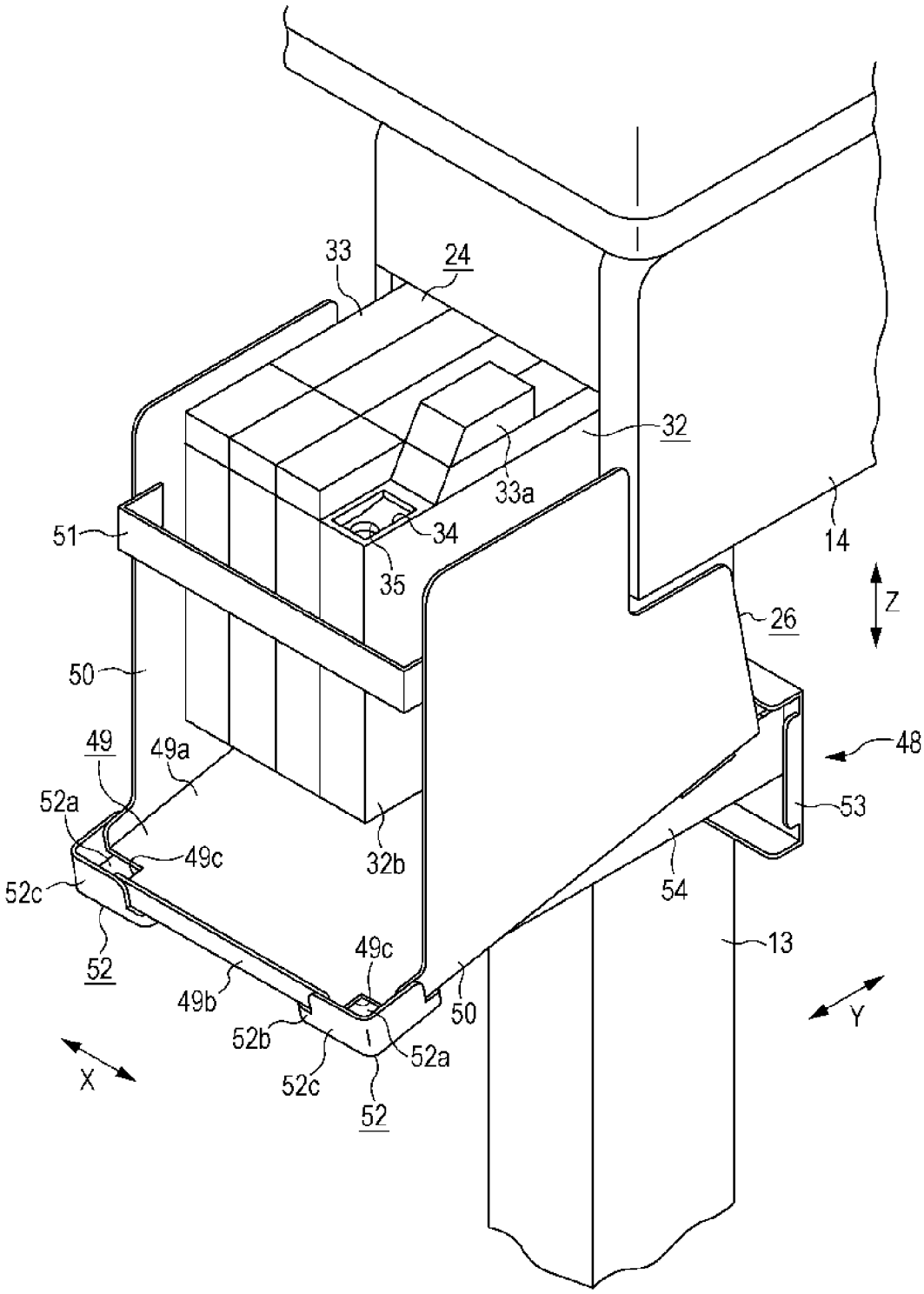
FIG. 10 is a perspective view showing the periphery of the liquid container.

As shown in FIG. 10, the protecting portion 26 is supported by one (a right-side leg portion in FIG. 10) of the leg portions 13 via a support unit 48 as an example of the support member. Furthermore, the protecting portion 26 has a liquid reception portion 49 having a plate shape and a pair of side walls 50 which extends upwardly from both end portions of the liquid reception portion 49 in the width direction X.

The liquid reception portion 49 is disposed on a lower side of the protruding portion 32*b*, which is a part of the liquid container 24. The liquid reception portion 49 is inclined so as to be gradually lowered from the casing body 14 side toward the front side (in the protruding direction). Further, the pair of side walls 50 is aligned in the width direction X so as to interpose the protruding portion 32*b* of the liquid accommodating body 32 therebetween. In addition, the protecting portion 26 has a reinforcing member 51 which connects front end sides of the pair of side walls 50.

In the liquid reception portion 49, an inclined surface 49*a*, which is an example of an inclined portion and inclined downward, is provided on an upper surface side. In addition, a wall portion 49*b* erected upwardly is provided on the front end side of the liquid reception portion 49. Furthermore, in the front end side of the liquid reception portion 49, notched portions 49*c* are respectively formed on both end sides thereof in the width direction X. Additionally, in a portion which is the lower end side of the liquid reception portion 49 and the lower end side of the protecting portion 26, a liquid storage member 52 constituting a liquid storage portion capable of storing ink is provided on a lower side of the notched portion 49*c*.

The liquid storage member 52 has a bottom wall portion 52*a*, a side wall portion 52*b* and a mounting portion 52*c* intersecting the side wall portion 52*b*. Further, in a state where the bottom wall portion 52*a* is disposed on a lower side of the notched portion 49*c*, the mounting portion 52*c* of the liquid storage member 52 is fixed to the wall portion 49*b* of the protecting portion 26 and one of the side walls 50.

Figure 11:
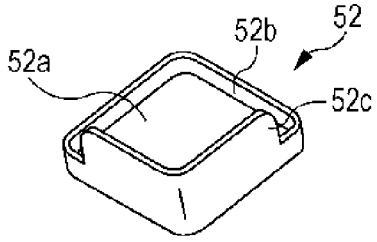
FIG. 11 is a perspective view of a liquid storage member.

The bottom wall portion 52*a* of the liquid storage member 52 has a plate shape and intersects the side wall portion 52*b* and a lower end side of the mounting portion 52*c*, as shown in FIG. 11. Further, a recess portion surrounded by the bottom wall portion 52*a*, the side wall portion 52*b* and the mounting portion 52*c* is formed on the liquid storage member 52. The recess portion can store ink.

Figure 12:
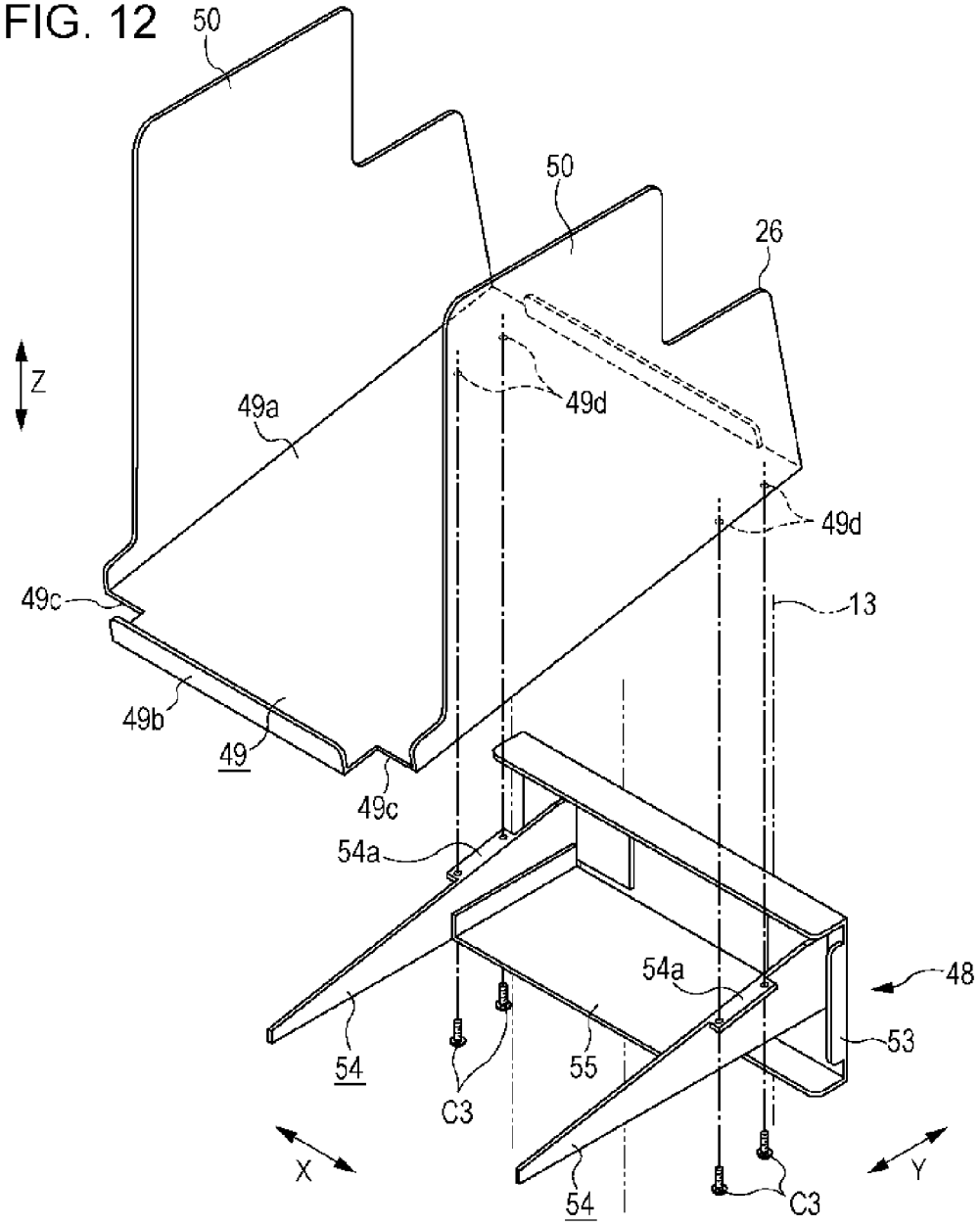
FIG. 12 is a perspective view for describing a configuration of a support unit.

The support unit 48 includes a fixing plate 53 fixed to the leg portion 13, a pair of joining members 54 of which base end sides are fixed to the fixing plate 53, and a reinforcing plate 55 connecting the pair of joining members 54, as shown in FIG. 12. In addition, joining portions 54*a* are respectively formed on upper portions of both joining members 54.

In the liquid reception portion 49 of the protecting portion 26, a pair of notched portions 49*c* is formed on a front end side, and screw holes 49*d* are formed on a rear end side. Furthermore, the liquid reception portion 49 of the protecting portion 26 is fixed to the joining portion 54*a* of the joining member 54 by a screw C3 inserted into the screw hole 49*d*.

Next, an operation of the liquid ejecting apparatus 11 configured as described above will be described.

The liquid container 24 of which the protruding portion 32*b* is exposed to the outside of the casing body 14 is connected with the liquid supply mechanism 31, as shown in FIG. 3. However, a part of the liquid container 24 exposed to the outside of the casing body 14 is surrounded by the protecting portion 26. Therefore, the liquid container 24 is protected from an external force by the protecting portion 26. In addition, the protecting portion 26 is fixed to the leg portion 13 separate from the casing body 14 and is disposed so as to interpose a space between the protecting portion 26 and the protruding portion 32*b* of the liquid container 24. Therefore, it is possible to suppress the influence of an external force on the liquid container 24 even when a person or an object collides with the protecting portion 26.

Particularly, since the leg portion 13 for supporting the casing body 14 is disposed on the lower side of the casing body 14 and the liquid container 24 is provided on the lower portion of the casing body 14, there is possibility that the protruding portion 32*b* may collide with the knee of a person, a bag carried by a person or the like. Furthermore, in the liquid container 24, the width direction X is a short direction. Therefore, when an external force acts on the protruding portion 32*b* from the lateral direction, the front end side of the liquid container 24 may pivot in the width direction X. Thus, there is a possibility that a connection failure may be caused between the liquid supply mechanism 31 and the connecting portion 32*c* positioned on the rear end side of the liquid container 24. However, since the protecting portion 26 has the side wall 50, the collision impact is absorbed by the side wall 50 instead of the protruding portion 32*b*. Therefore, it is possible to suppress the influence of an external force, which is applied from the lateral direction, on the liquid container 24.

Further, although the protecting portion 26 does not surround the upper side of the liquid container 24, the lower end side of the protruding portion 32*b* of the liquid container 24 is supported by the container support portion 38. Therefore, the displacement of the protruding portion 32*b* is suppressed even when an external force acts on the protruding portion 32*b* from the upper side.

Further, when the liquid container 24 is incompletely fixed to the container support portion 38, there is a possibility that the liquid container 24 may be affected greatly by an external force. However, when the adjusting member 45 is interposed between the liquid container 24 and the container support portion 38, the liquid container 24 is securely fixed to the container support portion 38, as shown in FIGS. 8 and 9. Therefore, the impact caused by the collision is suppressed. Further, the liquid container 24 is supported by the casing body 14 at two places of the inside and outside of the casing body 14. Therefore, the liquid container 24 is more firmly mounted to the casing body 14.

Furthermore, in the liquid container 24, the front-rear direction Y is a longitudinal direction, as shown in FIG. 3. Also, in the up-down direction Z, a length of the protruding portion 32*b* protruding from the casing body 14 is longer than a length of the base end portion 32*a* accommodated in the casing body 14. In other words, the amount of ink accommodated in the protruding portion 32*b* of the liquid container 24 is larger than the amount in the base end portion 32*a* thereof. Therefore, there is a possibility that the front end side may be inclined downward by the weight of the ink. However, the height of the front end side of the liquid container 24 is adjusted by the adjusting member 45. Also, the inclination of the liquid container 24 which is caused by tolerance in the design is adjusted by the adjusting member 45.

In some cases, it is possible to inject the ink in the refilling container BT into the liquid container 24. In this case, the opening size of the pouring port SP of the refilling container BT is set to be 20% to 80% of the opening size of the injection port 35, and thus the ink hardly leaks out from the injection port 35 or the injection recess portion 34, during the injection.

In addition, the liquid reception portion 49 inclined downward is disposed on a lower side of the protruding portion 32*b* and injection port 35 of the liquid container 24. Therefore, when the ink leaks out at the time of injecting the ink into the liquid container 24, the leaked ink is received by the liquid reception portion 49. In other words, since the protecting portion 26 which surrounds the protruding portion 32*b* provided with the injection port 35 is disposed between the transporting path of a paper sheet S and the injection port 35, the leaked ink is prevented from scattering around or adhering to the paper sheet S.

In addition, the ink received by the liquid reception portion 49 flows along the inclined surface 49*a*. Then, the ink passes through the notched portion 49*c* provided on the front end side of the liquid reception portion 49 and is collected in the liquid storage member 52 provided on the front side of the casing body 14. Thus, when removing the leaked ink, it is sufficient to clean only the liquid storage member 52. Therefore, it is easy to remove the leaked ink. Further, the protecting portion 26 is disposed so as to interpose a space between the protecting portion 26 and the liquid container 24. Therefore, the contamination of the liquid container 24 by the ink, which is adhered to the liquid reception portion 49 or the side wall 50 of the protecting portion 26, is suppressed.

In addition, the support unit 48 is installed on a rear-side portion of the liquid reception portion 49, which is located closer to the casing body 14 side than the injection port 35 in the front-rear direction Y (the protruding direction). In other words, the screw hole 49*d* of the liquid reception portion 49 is positioned at a portion which is further upward in the up-down direction Z than a part of the inclined surface 49*a* located just below the injection port 35. Thus, when the ink is received by the liquid reception portion 49, the ink is prevented from leaking out through the screw hole 49*d* provided on the liquid reception portion 49.

In addition, the protecting portion 26 is disposed between the liquid container 24 and the support member 17, as shown in FIG. 1. In other words, the heat emitted from the heater 17*a* is hardly transmitted to the liquid container 24 side, because the protecting portion 26 is disposed between the liquid container 24 and the heater 17*a* positioned on the rear side of the support member 17. Thus, the influence of heat, which is emitted from the heater 17*a*, on the ink in the liquid container 24 is suppressed.

According to the first embodiment described above, it is possible to achieve the following effects.

(1) The external force acting on a part (the protruding portion 32*b*) of the liquid container 24 exposed to the outside of the casing body 14 is reduced by the protecting portion 26. Therefore, it is possible to suppress the influence of the external force on the liquid container 24.

(2) A space is provided between the protecting portion 26 and a part (protruding portion 32*b*) of the liquid container 24 exposed to the outside of the casing body 14. Therefore, the liquid container 24 is hardly affected by an external force acting on the protecting portion 26. Thus, it is possible to suppress the influence of the external force on the liquid container 24.

(3) The protruding portion 32*b* of the liquid container 24 is supported by the container support portion 38. Therefore, the displacement of the connecting portion 32*c* is suppressed even when an external force acts on the protruding portion 32*b*. Thus, it is possible to maintain a favorable connecting state between the liquid container 24 and the liquid supply mechanism 31. As a result, the ink is prevented from leaking out through the connecting portion 32*c* of the liquid container 24.

(4) It is possible to adjust the position of the protruding portion 32*b* in the up-down direction Z by the adjusting member 45 constituting the adjustment mechanism so that the protruding portion 32*b* side of the liquid container 24 is not lowered than the connecting portion 32*c* side. Therefore, the displacement of the connecting portion 32*c* caused by an inclination of the liquid container 24 is suppressed. Thus, it is possible to maintain a favorable connecting state between the liquid container 24 and the liquid supply mechanism 31. As a result, the ink is prevented from leaking out through the connecting portion 32*c* of the liquid container 24.

(5) An external force acting on the protruding portion 32*b* of the liquid container 24 from the lateral direction is reduced by the side walls 50 of the protecting portion 26. Therefore, it is possible to suppress the influence of the external force on the liquid container 24.

(6) The external force acting on the protruding portion 32*b* of the liquid container 24 from below is reduced by the liquid reception portion 49. Therefore, it is possible to suppress the influence of an external force on the liquid container 24. Furthermore, when ink leaks out at the time of injecting the ink into the liquid container 24 through the injection port 35, the leaked ink is received by the liquid reception portion 49 disposed on the lower side of the protruding portion 32*b*. Therefore, it is possible to suppress contamination by the ink leaked at the time of injection. Furthermore, the liquid reception portion 49 is disposed in a state of being inclined from the casing body 14 side in the protruding direction, and therefore the received ink is collected in the lower end side of the liquid reception portion 49. Thus, it is easy to remove the leaked ink.

(7) The liquid storage member 52 is provided on the lower end side of the liquid reception portion 49 of the protecting portion 26. Therefore, it is possible to store the ink, which is received by the liquid reception portion 49, in the liquid storage member 52. Thus, it is possible to reduce the frequency of removing the ink leaked at the time of injection.

(8) The support unit 48 supporting the protecting portion 26 is fixed to the leg portion 13 separate from the casing body 14. Therefore, even when an external force acts on the protecting portion 26, it is possible to suppress the influence of the external force on the liquid container 24 mounted to the casing body 14.

(9) The joining portion 54*a* of the support unit 48 is joined to the rear end side of the liquid reception portion 49, which is located closer to the casing body 14 side than the injection port 35 in the protruding direction (the front-rear direction Y). Thus, even when the screw hole 49*d* used for joining is provided on the liquid reception portion 49, the leakage of the ink received by the liquid reception portion 49 is suppressed.

(10) The ink leaked at the time of injection is received by the liquid reception portion 49 disposed on the lower side of the injection port 35 which is provided in the liquid container 24. Therefore, it is possible to suppress the downward scattering of the ink leaked at the time of being injected into the liquid container 24.

(11) The ink received by the liquid reception portion 49 flows along the inclined surface 49*a* and is collected in the lower side of the liquid reception portion 49. Therefore, it is possible to easily remove the leaked ink.

(12) It is possible to store the ink, which is received by the liquid reception portion 49, flows along the inclined surface 49*a* and is collected, in the liquid storage member 52. Thus, it is possible to reduce the frequency of removing the leaked ink.

(13) The injection port 35 is provided in the protruding portion 32*b* of the liquid container 24, which is disposed outside the casing body 14. Therefore, it is possible to easily conduct the injection of ink. Furthermore, even when the ink leaks out at the time of injection, it is possible to suppress the internal contamination of the casing body 14 by the leaked ink. In addition, the liquid reception portion 49 is disposed on the lower side of the protruding portion 32*b*. Therefore, it is possible to receive the ink which leaks out at the time of injection and falls along the liquid container 24.

(14) It is possible to suppress the leakage of the ink at the time of injection, by stabilizing the protruding portion 32*b* using the container support portion 38.

(15) Since a space is provided between the liquid container 24 and the liquid reception portion 49, it is possible to suppress the adhesion of the ink, which is received by the liquid reception portion 49, to the liquid container 24.

(16) Since the protecting portion 26 is disposed between the transporting path of a paper sheet S and the injection port 35, it is possible to suppress the scattering of the leaked ink, which leaks out at the time of injection, over the transporting path of a paper sheet S. Therefore, it is possible to suppress contamination by the ink leaked at the time of being injected into the liquid container 24.

(17) Since a space is provided between the liquid container 24 and the protecting portion 26, it is possible to suppress the contamination of the liquid container 24 by the ink adhered to the protecting portion 26.

(18) Since the ink falling from the liquid container 24 at the time of injection is received by the liquid reception portion 49, the contamination is suppressed with respect to a member and the paper sheet S positioned on the lower side of the liquid container 24. Furthermore, since the ink received by the liquid reception portion 49 flows along the inclined surface and is collected in the lower side of the liquid reception portion 49, it is possible to easily remove the leaked ink.

(19) Since the protecting portion 26 surrounds the protruding portion 32*b*, it is possible to suppress the scattering of the ink leaked at the time of injection.

Second Embodiment

Next, a second embodiment of the liquid ejecting apparatus will be described with reference to drawings. The following description is focused on differences from the first embodiment described above.

Figure 13:
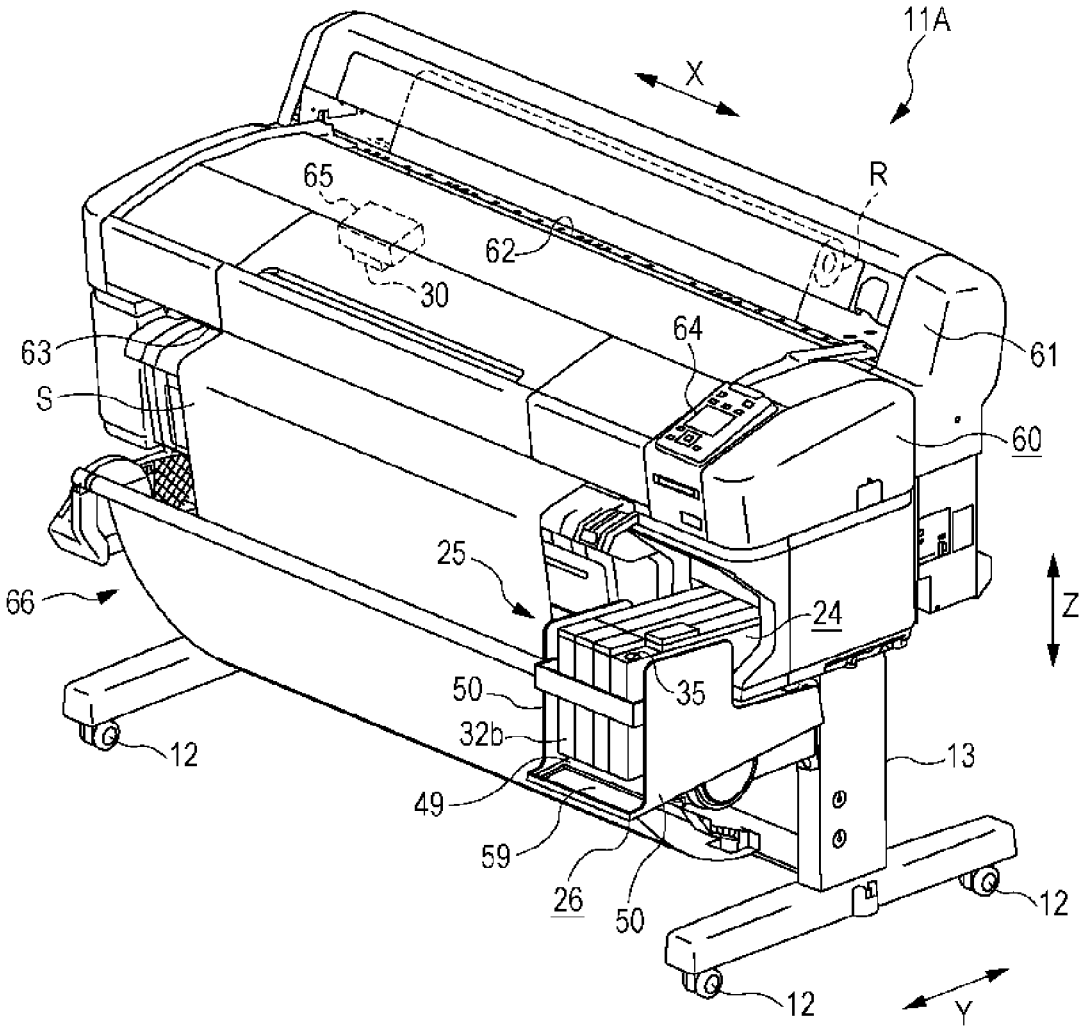
FIG. 13 is a perspective view of a liquid ejecting apparatus according to a second embodiment.

As shown in FIG. 13, a liquid ejecting apparatus 11A of the embodiment includes the leg portions 13 which are provided with the wheels 12 on the lower ends thereof, and a casing body 60 assembled on the leg portions 13. A feeding portion 61 protruding upward is provided on a rear portion of the casing body 60. A roll body R which is a cylindrically wound paper sheet S as an example of a lengthy medium is loaded in the feeding portion 61.

In the casing body 60, an inserting port 62 for introducing the paper sheet S sent from the feeding portion 61 into the casing body 60 is formed at a position on the front side of the feeding portion 61. In addition, a discharging port 63 for discharging the paper sheet S outside the casing body 60 is formed on a front surface side of the casing body 60. Furthermore, a transporting mechanism (not shown) which transports the paper sheet S fed from the feeding portion 61 from the inserting port 62 side to the discharging port 63 side is accommodated in the casing body 60.

An operation panel 64 for conducting a setting operation or an input operation is provided on an upper portion of the casing body 60. Specifically, the operation panel 64 is positioned on one end side (a right end side in FIG. 13) of the upper portion in the width direction X, which is outside the transporting path of a paper sheet S. In addition, a liquid container 24 capable of accommodating ink as an example of the liquid is provided on the lower portion of the casing body 60. Specifically, the liquid container 24 is positioned on one end side (the right end side in FIG. 13) of the lower portion in the width direction X, which is outside the transporting path of a paper sheet S.

A plurality (four in the embodiment) of liquid containers 24 are provided corresponding to types or colors of ink. Further, the plurality of liquid containers 24 are mounted to the casing body 60 in a state of being aligned in the width direction X. The mounted liquid containers 24 constitute the liquid accommodating unit 25.

The liquid ejecting apparatus 11A includes the protecting portion 26 which surrounds the protruding portion 32*b* of the liquid container 24. Furthermore, a liquid storage portion 59 is recessed on the front end side (lower end side) of the liquid reception portion 49 of the protecting portion 26. However, the notched portion 49*c* and the liquid storage member 52 are not provided in the liquid reception portion 49 of the embodiment.

In addition, a carriage 65 which reciprocates in the scanning direction (the width direction X in the embodiment) perpendicular to the transporting direction of the paper sheet S is accommodated in the casing body 60. Furthermore, the liquid ejecting portion 30 capable of ejecting ink is held on the lower portion of the carriage 65. Furthermore, recording (printing) is carried out by causing the liquid ejecting portion 30 to eject the ink supplied from the liquid container 24 onto the paper sheet S.

In the lower portion of the front side of the casing body 60, a medium receiving unit 66 constituting a downstream-side part of the transporting path of a paper sheet S is installed on the leg portion 13. Further, the paper sheet S discharged from the casing body 60 through the discharging port 63 is received by the medium receiving unit 66.

Next, an operation of the liquid ejecting apparatus 11A constituted as described above will be described.

The protecting portion 26 is disposed between the injection port 35 and the medium receiving unit 66 constituting the transporting path of a paper sheet S so as to surround the protruding portion 32*b* of the liquid container 24 provided with the injection port 35. Therefore, the ink leaked at the time of being injected into the liquid container 24 is received by the protecting portion 26, and thus the scattering of the ink over the medium receiving unit 66 is suppressed. As a result, the contamination of the paper sheet S by the ink leaked at the time of injection is suppressed.

In addition, the ink received by the liquid reception portion 49 is collected in the liquid storage portion 59 provided on the front end side of the liquid reception portion 49. Thus, when removing the leaked ink, it is sufficient to clean only the liquid storage portion 59. Therefore, it is easy to remove the leaked ink.

According to the second embodiment described above, it is possible to achieve the following effect, in addition to the effects (1) to (19).

(20) Since the liquid storage portion 59 is recessed on the front end side of the liquid reception portion 49 of the protecting portion 26, it is possible to store the ink in the liquid storage portion 59 that has a simple configuration.

Third Embodiment

Next, a third embodiment of the liquid ejecting apparatus will be described with reference to drawings. The following description is focused on differences from the second embodiment described above.

Figure 14:
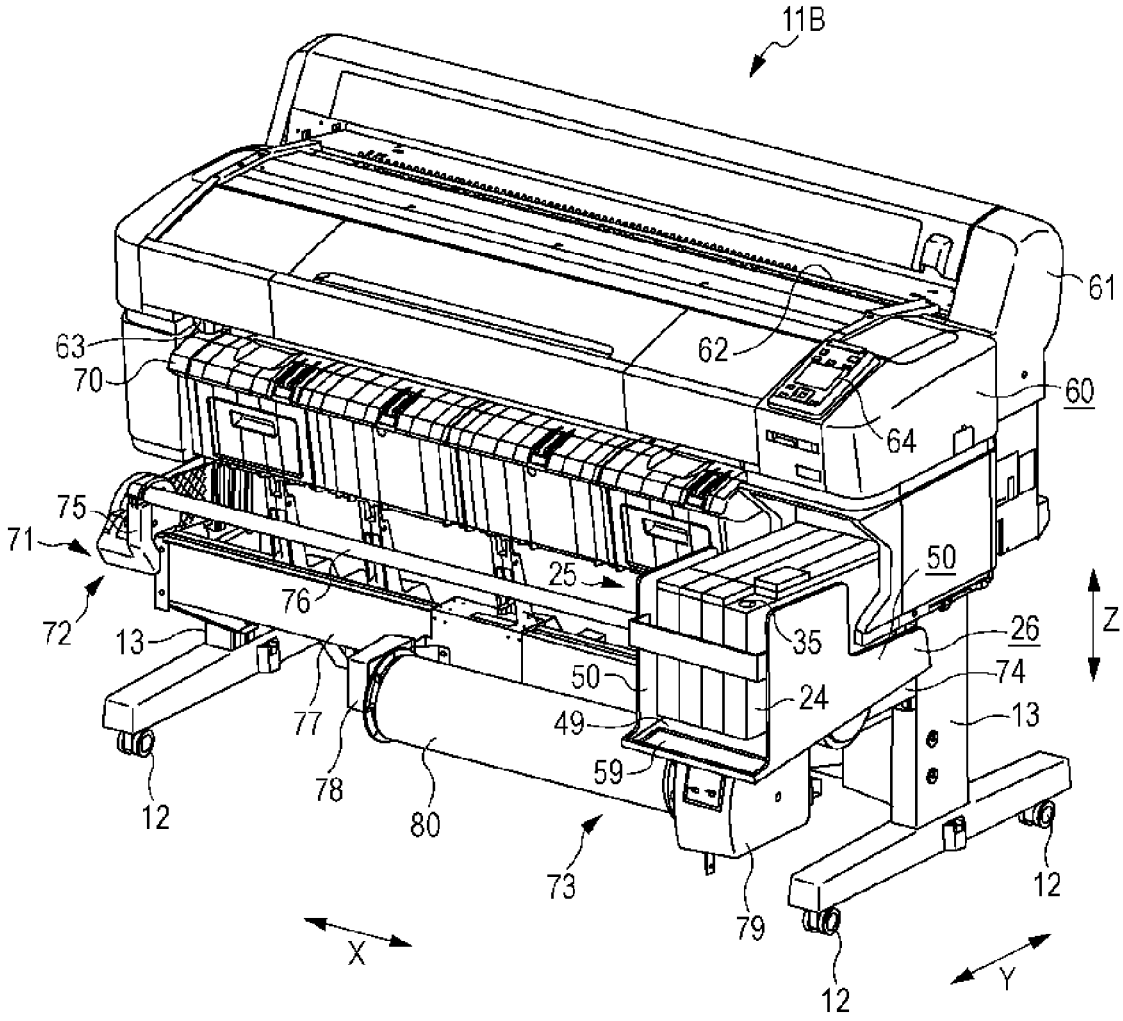
FIG. 14 is a perspective view of a liquid ejecting apparatus according to a third embodiment.

In the liquid ejecting apparatus 11B of the embodiment, a paper discharge guide portion 70 which extends horizontally from a lower-end side edge of the discharging port 63 toward the front side is provided on the front surface side of the casing body 60, as shown in FIG. 14.

In addition, a medium recovery unit 71 constituting a transporting mechanism of a paper sheet S is provided on a lower portion of a front side of the casing body 60. The medium recovery unit 71 includes a rotating arm mechanism 72 supported by the leg portion 13, and a winding mechanism 73 disposed on the lower side of the rotating arm mechanism 72.

The rotating arm mechanism 72 includes a pair of base portions 74 extending horizontally from the leg portions 13 toward the front side, and a pair of arm portions 75 rotatably connected to the base portions 74. In addition, a support shaft 76 is installed on the front end side of the pair of arm portions 75.

The winding mechanism 73 includes a support frame 77 connected with the leg portion 13, a roller holder 78 supported by the support frame 77, and a driving device 79 connected to the roller holder 78. Furthermore, a winding shaft 80 is rotatably held by the roller holder 78.

A motor (not shown) for rotating the winding shaft 80, a circuit substrate portion (not shown) which constitutes a control portion for controlling the motor, and a power supply (not shown) for supplying a power to the motor are accommodated in the driving device 79.

Figure 15:
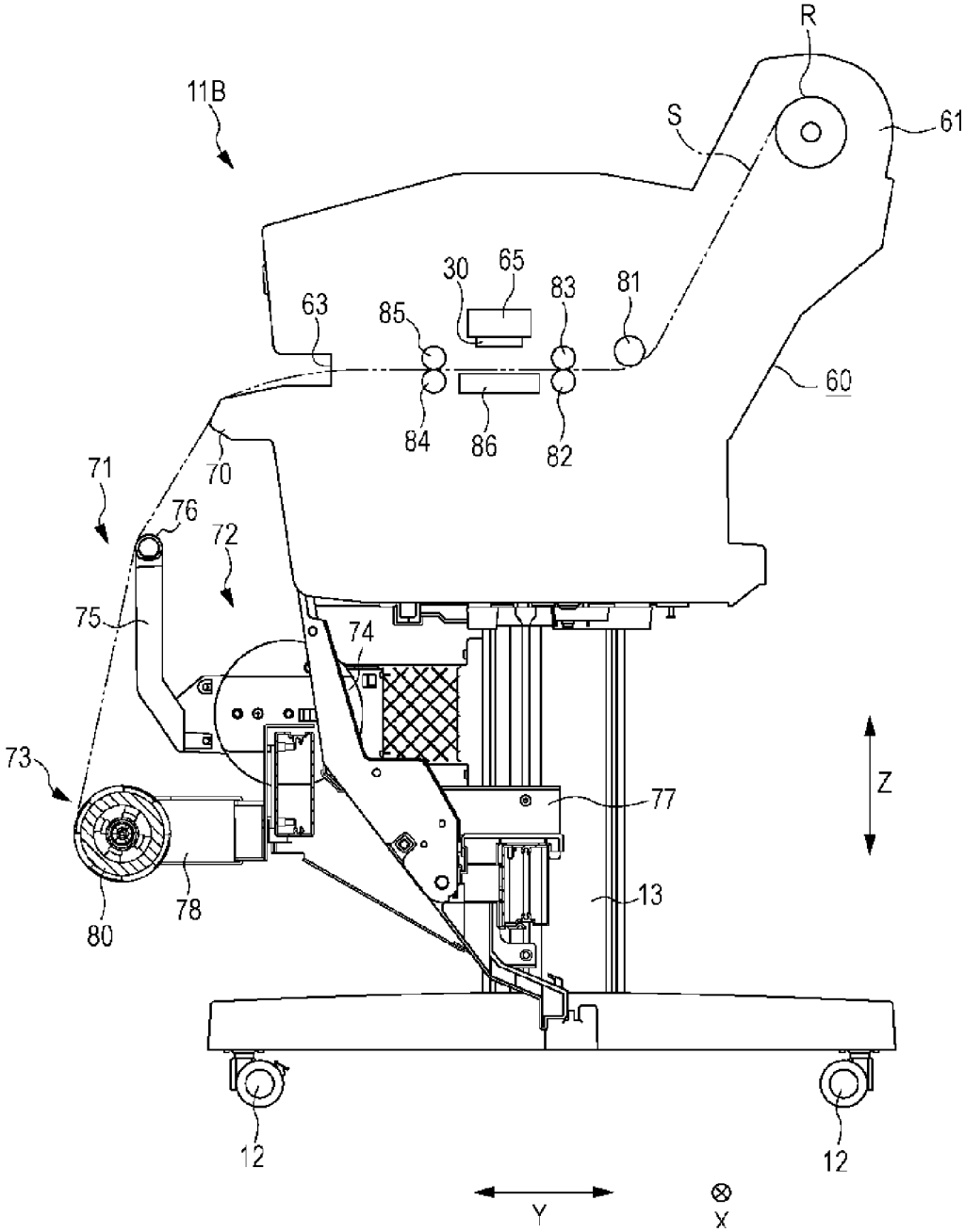
FIG. 15 is a cross-sectional view showing a schematic configuration of the liquid ejecting apparatus according to the third embodiment.

A plurality of transporting rollers 81, 82, 83, 84 and 85 for transporting a paper sheet S along the transporting path are provided in the casing body 60, as shown in FIG. 15. Further, in the transporting path of a paper sheet S, the carriage 65 holding the liquid ejecting portion 30 is disposed between the transporting rollers 82 and 83 and the transporting rollers 84 and 85 of the transporting rollers 81 to 85. In addition, a support plate 86 which supports a paper sheet S transported by the transporting rollers 81 to 85 is provided on the lower side of the carriage 65.

The printed paper sheet S is discharged outside the casing body 60 through the discharging port 63 and then wound on the winding shaft 80. In this case, the paper sheet S positioned between the paper discharge guide portion 70 and the winding shaft 80 is stretched tightly by the support shaft 76 applying tension thereto.

Next, an operation of the liquid ejecting apparatus 11B configured as described above will be described.

The protecting portion 26 is disposed between the driving device 79 and the injection port 35 so as to surround the protruding portion 32*b* provided with the injection port 35, as shown in FIG. 14. Therefore, the scattering of the ink over the medium recovery unit 71 or the driving device 79 is suppressed even when the ink leaks out at the time of being injected into the liquid container 24.

According to the third embodiment described above, it is possible to achieve the following effect, in addition to the effects (1) to (20).

(21) Since the protecting portion 26 is disposed between the driving device 79 and the injection port 35, it is possible to suppress the scattering of the leaked ink, which leaks out at the time of injection, over the transporting path of a paper sheet S or the driving device 79. Therefore, when the ink is injected into the liquid container 24, it is possible to suppress the contamination of the paper sheet S or the driving device 79 by the leaked ink.

In addition, the embodiments described above may be modified as follows.

- The liquid container 24 may or may not include protruding portion 32*b*.
- The protecting portion 26 may include one or neither of the side walls 50. In this case, it is preferable that the liquid reception portion 49 is inclined so as to cause one side (a right side in FIG. 1) in the width direction X to be placed further downward than the other side (a left side in FIG. 1). In addition, it is preferable that the other end side (the left end side) of the liquid reception portion 49 extends to the other side (the left side). In this case, a part of the liquid reception portion 49 extending to the other side may be disposed at a place higher than the lower end of the liquid container 24. According to the configuration described above, it is possible for the liquid reception portion 49 to suppress the scattering of the ink over the transporting path of a paper sheet S or the driving device 79, which are disposed further left than the liquid container 24 in the width direction X, even when the side wall 50 is not provided.
- The protecting portion 26 may abut on the liquid container 24.
- It is possible to change the number of liquid containers 24 arbitrarily. Alternatively, the liquid accommodating unit 25 may be constituted by the liquid container 24 provided with the injection port 35 and the liquid container 24 not provided with the injection port 35. When the liquid container 24 corresponding to a black ink is provided with the injection port 35, it is possible to continuously conduct a large quantity of monochrome printing when performing monochrome printing. In this case, the liquid container 24 corresponding to a color ink may or may not be provided with the protruding portion 32*b* and the injection port 35. Further, the entire part of the liquid container 24 may be accommodated in the casing body 14.
- The liquid container 24 may be disposed at the position where the transporting path of a paper sheet S or the driving device 79 is overlapped with the liquid container 24 in the width direction X.

The liquid container 24 in which ink is accommodated in advance may be connected with the liquid supply mechanism 31. Alternatively, the empty liquid container 24 in which ink is not accommodated may be connected with the liquid supply mechanism 31, and then the ink may be injected into the liquid container 24 through the injection port 35.

To perform injection and printing at the same time, the injection port 35 of the liquid container 24 may be connected with a downstream end of an ink tube of which an upstream end is connected with an ink tank disposed outside of the casing body 14.

The protruding portion 32*b* of the liquid container 24 may protrude upward, downward or rearward from the casing body 14 or 60.

In the liquid container 24, only the injection port 35 may protrude outside of the casing body 14 or 60.

The injection port 35 for injecting ink may protrude from a side surface or a front surface of the liquid container 24. In this case, the protecting portion 26 may be disposed so as to surround the protruding injection port 35.

The adjusting member 45 may or may not be included.

The adjusting member 45 may include three or more adjustment portions having different thicknesses. Further, the height of the protruding portion 32*b* may be adjusted by inserting a plurality of adjusting members having different thickness between the support side wall 39*a* of the fixing member 39 and the placing portion 43 of the placing member 40. Alternatively, the height of the protruding portion 32*b* may be adjusted by inserting a plurality of adjusting members having the same thickness between the support side wall 39*a* of the fixing member 39 and the placing portion 43 of the placing member 40.

The support unit 48 may be fixed to the casing body 14.

The container support portion 38 may or may not be included. In this case, the protruding portion 32*b* of the liquid container 24 may be supported by the support unit 48.

The liquid reception portion 49 may or may not be inclined downward (a configuration not including an inclined portion).

A groove-shaped inclined portion inclined downward may be provided on an upper surface side of the liquid reception portion 49.

A through hole may be formed on the liquid reception portion 49 and an inclined portion which is inclined to be lowered toward the through hole may be provided on the liquid reception portion 49. According to the configuration, it is possible to discharge the ink accommodated in the liquid reception portion 49 through the through hole. In this case, the liquid storage portion may be provided on the lower side of the through hole.

The liquid storage member 52 may or may not be included.

A member capable of absorbing liquid, such as a porous member, may be disposed on the liquid storage portion.

When the screw hole 49*d* is not provided on the liquid reception portion 49, the joining portion 54*a* of the joining member 54 may be joined to an arbitrary position of the liquid reception portion 49.

In the liquid ejecting apparatus 11 of the first embodiment, the entirety of the liquid container 24 is disposed further downward than the carriage 29, as shown in FIG. 2. However, only a part of liquid container 24 may be disposed on the lower side of the carriage 29. Alternatively, the liquid container 24 may be disposed on the upper side of the carriage 29.

The liquid ejecting apparatus 11 of the first embodiment may be provided with the liquid reception portion 49 included in the liquid ejecting apparatus 11A of the second embodiment. Further, the liquid ejecting apparatus 11A of the second embodiment may be provided with the liquid reception portion 49 included in the liquid ejecting apparatus 11 of the first embodiment.

In the first embodiment, the ink accommodated in the liquid reception portion 49 may be introduced into the waste liquid tank 27. According to the configuration, removing the leaked ink is unnecessary.

In the first embodiment, the liquid reception portion 49 may be provided with only one liquid storage member 52. In this case, the notched portion 49*c* and the liquid storage member 52 may be disposed on one end side of the liquid reception portion 49 in the width direction X. Alternatively, the notched portion 49*c* and the liquid storage member 52 may be disposed in the middle of the liquid reception portion 49 in the width direction X. Further, when the notched portion 49*c* and the liquid storage member 52 is disposed on one end side of the liquid reception portion 49 in the width direction X, the inclined surface 49*a* of the liquid reception portion 49 may be inclined so as to be gradually lowered from the other end side thereof in the width direction X toward one end side.

In the third embodiment, a motor or a circuit substrate portion for driving the carriage 65, the liquid ejecting portion 30, the transporting rollers 81, 82, 83, 84 and 85 and the like may be accommodated in the driving device 79. Furthermore, a control device which accommodates a control portion for controlling the liquid ejecting apparatus 11B may be disposed at the position where the driving device 79 is disposed.

In each embodiment described above, the liquid ejecting apparatus may be a liquid ejecting apparatus that ejects or discharges a liquid aside from ink. Furthermore, the small amount of liquid discharged from the liquid ejecting apparatus includes granule forms, teardrop forms, and forms that pull trails in a string-like form therebehind. In addition, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a liquid carrier are included as well. Ink, a liquid crystal or the like is exemplified as a representative example of a liquid in the embodiments described above. In this case, the ink includes a general water-based ink and oil-based ink, aside from various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, a printing equipment, a micro dispenser or the like. Further, the liquid ejecting apparatus may be a liquid ejecting apparatus for precisely ejecting lubricant to a precision machine such as a watch or a camera, or a liquid ejecting apparatus that ejects on a substrate a transparent resin liquid such as an ultraviolet curing resin in order to form a minute hemispherical lens (an optical lens) used in an optical communication element or the like. In addition, the liquid ejecting apparatus may be a liquid ejecting apparatus that ejects an etching liquid such as acid or alkali to etch a substrate or the like.

The entire disclosure of Japanese Patent Application No. 2012-191472, filed Aug. 31, 2012 is expressly incorporated by reference herein.

What is claimed is:

1. A liquid ejecting apparatus comprising:

a liquid ejecting portion capable of ejecting liquid;

a liquid container provided with an injection port for liquid;

a liquid reception portion disposed on a lower side of the injection port;

a liquid supply mechanism for supplying liquid accommodated in the liquid container to the liquid ejecting portion; and a casing body which accommodates the liquid ejecting portion and the liquid supply mechanism, wherein the liquid container has a connecting portion connected with the liquid supply mechanism in the casing body and a protruding portion protruding outside the casing body and wherein the injection port is provided on the protruding portion, and the liquid reception portion is disposed on a lower side of the protruding portion.

2. The liquid ejecting apparatus according to claim 1, wherein a container support portion for supporting the protruding portion is provided on the casing body.

3. The liquid ejecting apparatus according to claim 1, further comprising:

a support member which supports the liquid reception portion and has a joining portion to be joined to the liquid reception portion at a position located closer to the casing body side than the injection port in a protruding direction, wherein the protruding portion of the liquid container protrudes from the casing body in the protruding direction intersecting an up-down direction and wherein the liquid reception portion has a plate shape inclined so as to be gradually lower from the casing body side in the protruding direction.

4. The liquid ejecting apparatus according to claim 1, wherein a space is provided between the liquid container and the liquid reception portion.

5. The liquid ejecting apparatus according to claim 1, wherein an inclined portion inclined downward is provided on an upper surface side of the liquid reception portion.

6. The liquid ejecting apparatus according to claim 5, wherein a liquid storage portion capable of storing liquid is provided on a lower end side of the inclined portion in the liquid reception portion.

* * * * *